US007564200B2

(12) United States Patent
Ichikawa et al.

(10) Patent No.: US 7,564,200 B2
(45) Date of Patent: Jul. 21, 2009

(54) DISCHARGE LAMP LIGHTING CIRCUIT WITH FREQUENCY CONTROL IN ACCORDANCE WITH PHASE DIFFERENCE

(75) Inventors: Tomoyuki Ichikawa, Shizuoka (JP); Takao Muramatsu, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 11/961,481

(22) Filed: Dec. 20, 2007

(65) Prior Publication Data

US 2008/0150445 A1 Jun. 26, 2008

(30) Foreign Application Priority Data

Dec. 22, 2006 (JP) ..... 2006-346278

(51) Int. Cl.
*G05F 1/00* (2006.01)

(52) U.S. Cl. ..... 315/308; 315/307; 315/291; 315/224; 315/274

(58) Field of Classification Search ..... 315/308, 315/307, 299, 301, 294, 291, 224, 225, 209 R, 315/274–279
See application file for complete search history.

(56) References Cited

U.S. PATENT DOCUMENTS 6,060,843 A * 5/2000 Primisser et al. ..... 315/291
6,326,740 B1 * 12/2001 Chang et al. ..... 315/291
6,433,458 B2 * 8/2002 Nakatsuka et al. ..... 310/316.01
6,509,699 B2 * 1/2003 Kim et al. ..... 315/291
2008/0218096 A1 * 9/2008 Fang ..... 315/224

FOREIGN PATENT DOCUMENTS

JP 2005-63821 A 3/2005

* cited by examiner

*Primary Examiner*—Tuyet Vo
(74) *Attorney, Agent, or Firm*—Sughrue Mion, PLLC

(57) ABSTRACT

A discharge lamp lighting circuit is provided. The discharge lamp lighting circuit includes a power supplying portion which comprises an inverter circuit comprising a switching element; a series resonant circuit comprising a capacitor, and at least one of an inductor and a transformer; and a driving circuit which drives said switching element, said power supplying portion converting DC power to AC power and supplying the AC power to a discharge lamp; and a controlling portion which produces a frequency control signal for controlling a frequency of a drive signal output from said driving circuit, the controlling portion including a phase difference detecting portion which detects a phase difference between an input voltage and an input current that are supplied from said inverter circuit to said series resonant circuit; and a control signal producing portion which produces the frequency control signal in accordance with the phase difference.

5 Claims, 9 Drawing Sheets

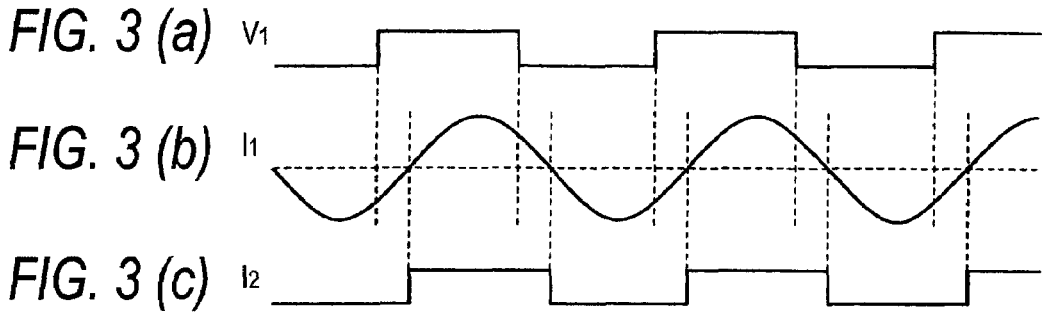
FIG. 3 (a)
V1
FIG. 3 (b)
I1
FIG. 3 (c)
I2
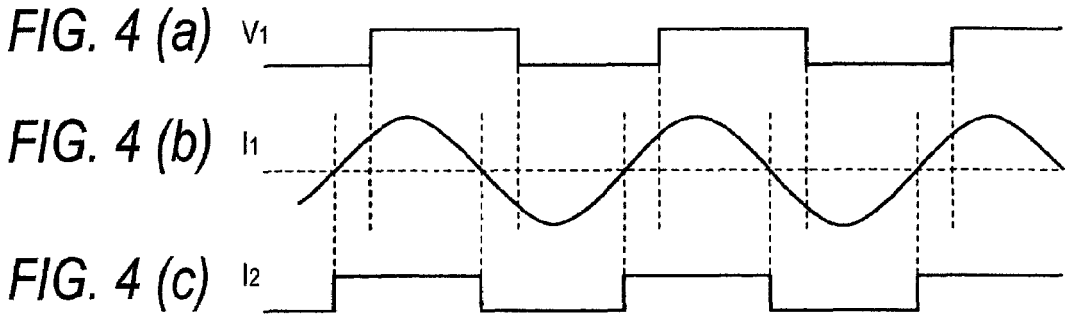
FIG. 4 (a)
V1
FIG. 4 (b)
I1
FIG. 4 (c)
I2

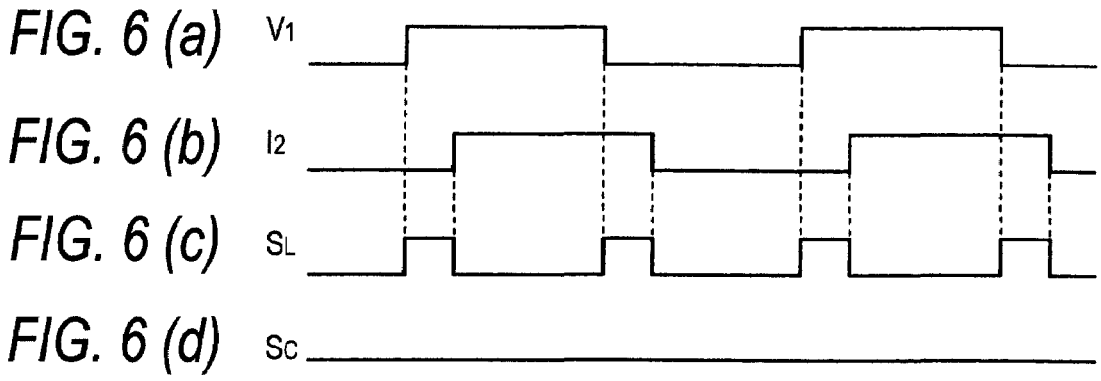
FIG. 6 (a)
V1
FIG. 6 (b)
I2
FIG. 6 (c)
SL
FIG. 6 (d)
Sc
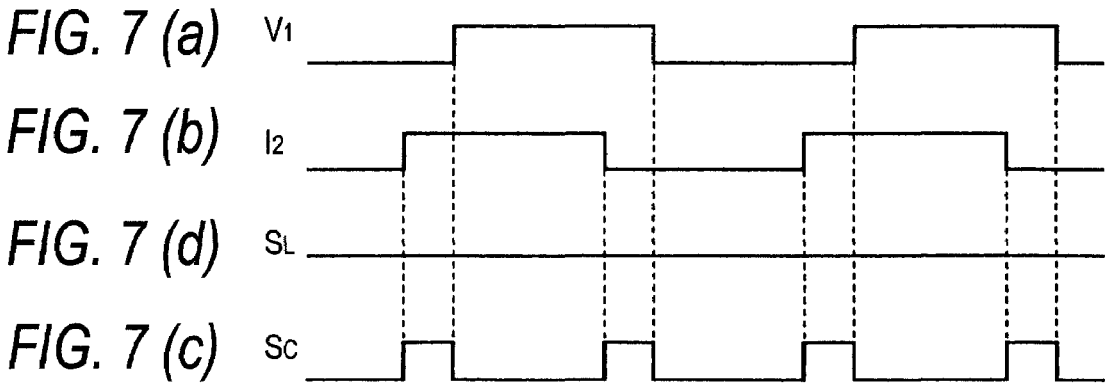
FIG. 7 (a)
V1
FIG. 7 (b)
I2
FIG. 7 (d)
SL
FIG. 7 (c)
Sc

DISCHARGE LAMP LIGHTING CIRCUIT WITH FREQUENCY CONTROL IN ACCORDANCE WITH PHASE DIFFERENCE

This application claims priority from Japanese Patent Application No. 2006-346278, filed Dec. 22, 2006, in the Japanese Patent Office. The Japanese Patent Application No. 2006-346278 is herein incorporated by reference in its entirety.

TECHNICAL FIELD

Apparatuses consistent with the present invention relate to a discharge lamp lighting circuit.

RELATED ART

In order to light a discharge lamp such as a metal halide lamp used as a head lamp for a vehicle, a lighting circuit (i.e, a ballast) for stably supplying a power to the lamp is necessary. For example, Japanese Patent Unexamined Publication No. 2005-63821 shows a related art discharge lamp lighting circuit which includes a DC-AC converting circuit including a series resonant circuit. The DC-AC converting circuit supplies an AC power to a discharge lamp. The level of the supplied power is controlled by changing the driving frequency of the series resonant circuit.

Related art discharge lamp lighting circuits also control lighting of a discharge lamp. Namely, before lighting of the discharge lamp, the related art discharge lamp lighting circuit controls an open circuit voltage (OCV), applies a high-voltage pulse to the discharge lamp to light the discharge lamp, and thereafter transfers a state of the discharge lamp to a steady lighting state while reducing a transient input power.

FIG. 11 is a graph conceptually showing relationships between the driving frequency of the series resonant circuit and the level of the supplied power (i.e., the OCV). In FIG. 11, the graph Ga shows relationships between the driving frequency and the OCV before lighting, and the graph Gb shows relationships between the driving frequency and the supplied power after lighting. As shown in FIG. 11, the level of the supplied power (or the OCV) to the discharge lamp has a maximum value when the driving frequency is equal to the series resonant frequency (i.e., fa before lighting, fb after lighting), and further decreases as the driving frequency is increased (or decreased) from the series resonant frequency. In a region where the driving frequency is lower than the series resonant frequency, the switching loss is large and the power efficiency is reduced. Therefore, a magnitude of the driving frequency is controlled to be in a region where the driving frequency is higher than the series resonant frequency.

In the lighting control of a discharge lamp, the operating point before lighting is set to a point Pa corresponding to a driving frequency fc which is higher than the series resonant frequency fa, and that after lighting is set to a region X where the driving frequency is higher than the series resonant frequency fb. In a related art discharge lamp lighting circuit, for example, the transition from the point Pa to the region X is performed in the following manner. After the discharge lamp is lighted at the operating point Pa, the driving frequency fc before lighting is maintained only for a certain constant time period. At this time, the relation between the driving frequency and the supplied power is changed to the graph Gb, and hence the operating point is transferred to the point Pc. Thereafter, the driving frequency is compulsively changed by a predetermined change amount Δf (=fd−fc), and the operating point is transferred to the point Pb in the region X.

However, a problem exists in the related art in that it is very difficult to set the frequency change Δf due to considerations of variations of the power source voltage, dispersions of the operating temperature, and errors of electrical characteristics of electronic components. The characteristics of electronic components used in a discharge lamp lighting circuit are dispersed, and the difference (fb−fa) between the resonant frequencies before and after lighting is different for each discharge lamp lighting circuit. Even in the case where Δf is adjusted for each circuit, when the characteristics of the circuit change due to, for example, aging deterioration, there is a possibility that the unchanged initial Δf causes the lighting property to deteriorate.

In order to, immediately after the start of lighting, grow an arc discharge of a discharge lamp to stabilize the lighting state, a power at a certain level or higher must be supplied from the power source to the series resonant circuit. In the above-described related art method in which the frequency change amount is previously set, however, there is a case where a power sufficient for ensuring the lighting stability cannot be ensured.

SUMMARY

Exemplary embodiments of the present invention provide a discharge lamp lighting circuit which, in a lighting control of a discharge lamp, can sufficiently maintain a lighting property correspondingly with environmental characteristics such as variations of a power source voltage and dispersions of the operating temperature, and changing characteristics of circuit components.

In order to address the above-mentioned disadvantages in the related art, as an aspect of the present invention, there is provided a discharge lamp lighting circuit which supplies an AC power for lighting a discharge lamp, to the discharge lamp, wherein the discharge lamp lighting circuit comprises a power supplying portion having: an inverter circuit including a switching element; a series resonant circuit including at least one of an inductor and a transformer, and a capacitor; and a driving circuit which drives the switching element, the power supplying portion converting an output of a DC power source to supply AC power to the discharge lamp; and a controlling portion which produces a frequency control signal that controls a frequency of a drive signal output from the driving circuit, and the controlling portion has: a phase difference detecting portion which detects a phase difference between an input voltage and an input current that are supplied from the inverter circuit to the series resonant circuit; and a control signal producing portion which produces the frequency control signal so as to increase or decrease the frequency of the drive signal in accordance with the phase difference.

In the discharge lamp lighting circuit, the phase difference between the input voltage and input current that are supplied from the inverter circuit to the series resonant circuit is detected, whereby the inductive and capacitive depths of the series resonant circuit as viewed from the inverter circuit are determined, and the driving frequency of the inverter circuit is increased or decreased on the basis of the phase difference. According to such a configuration, the driving frequency of the inverter circuit can be adjusted following the resonant frequency of the series resonant circuit. Even when circuit or environmental characteristics are varied, therefore, a sufficient power can be supplied to the discharge lamp, and the lighting stability of the discharge lamp can be advantageously ensured.

The phase difference detecting portion may include: a first phase difference detecting circuit which, when the phase of the input voltage leads the phase of the input current, produces an inductive detection signal having a pulse width that is proportional to the phase difference; and a second phase difference detecting circuit which, when the phase of the input voltage lags the phase of the input current, produces a capacitive detection signal having a pulse width that is proportional to the phase difference, the control signal producing portion includes: a detection capacitor in which one end is set to a first voltage; a charging circuit which is coupled to another end of the detection capacitor, and which supplies a current to the other end of the detection capacitor in accordance with one of the inductive detection signal and the capacitive detection signal; a discharging circuit which is coupled to the other end of the detection capacitor, and which sinks a current from the other end of the detection capacitor in accordance with another one of the inductive detection signal and the capacitive detection signal; and a signal producing circuit which detects a voltage across the detection capacitor, and which produces the frequency control signal so as to increase or decrease the frequency of the drive signal in accordance with the across voltage, and the first voltage is set to a value between a power source voltage supplied to the charging circuit, and a power source voltage supplied to the discharging circuit.

In such a case, by the phase difference detecting portion, the signal having the pulse width corresponding to the inductive depth is produced, and the signal having the pulse width corresponding to the capacitive depth is produced. In the control signal producing portion, the detection capacitor is charged or discharged in accordance with pulses of the two signals, and the driving frequency of the drive signal of the inverter circuit is adjusted according to the voltage across the detection capacitor. Therefore, the driving frequency of the inverter circuit can be caused to follow the resonant frequency of the series resonant circuit by a simple circuit configuration. The one end of the detection capacitor is set to a value between the power source voltage of the charging circuit, and that of the discharging circuit, thereby enabling the frequency to surely follow in accordance with both the inductive and capacitive states of the series resonant circuit.

The discharge lamp lighting circuit may further comprise a starting portion which applies a high-voltage pulse to the discharge lamp to promote lighting, and the control signal producing portion discharges the detection capacitor in accordance with detection of the high-voltage pulse in the starting portion. According to this configuration, in the case where the circuit is set so that the driving frequency is rapidly changed after the application of the high-voltage pulse, the state of the series resonant circuit which was detected in the past is reset at the start of lighting, whereby the frequency can be caused to follow immediately and stably the resonant frequency of the series resonant circuit in accordance with the state at the start of lighting.

The discharge lamp lighting circuit may further comprise a starting portion which applies a high-voltage pulse to the discharge lamp to promote lighting, the phase difference detecting portion includes: a first phase difference detecting circuit which, when the phase of the input voltage leads the phase of the input current, produces an inductive detection signal having a pulse width that is proportional to the phase difference; and a second phase difference detecting circuit which, when the phase of the input voltage lags the phase of the input current, produces a capacitive detection signal having a pulse width that is proportional to the phase difference, and the control signal producing portion includes: a detection capacitor; a charging circuit which is coupled to the detection capacitor, and which supplies a current to the detection capacitor in accordance with one of the inductive detection signal and the capacitive detection signal; a discharging circuit which is coupled to the detection capacitor, and which sinks a current from the detection capacitor in accordance with another one of the inductive detection signal and the capacitive detection signal; a signal producing circuit which receives a voltage across the detection capacitor, and which produces the frequency control signal so as to increase or decrease the frequency of the drive signal in accordance with the voltage across the detection capacitor; and a switch portion which supplies the voltage across the detection capacitor to the signal producing circuit in accordance with detection of the high-voltage pulse in the starting portion, and which, before detection of the high-voltage pulse, applies a voltage corresponding to a present frequency of the drive signal, to the detection capacitor.

In this case, by the phase difference detecting portion, the signal having the pulse width corresponding to the inductive depth is produced, and the signal having the pulse width corresponding to the capacitive depth is produced. In the control signal producing portion, the detection capacitor is charged or discharged in accordance with pulses of the two signals, and the driving frequency of the drive signal of the inverter circuit is adjusted in accordance with the across voltage of the detection capacitor. According to the configuration, the driving frequency of the inverter circuit can be caused to follow the resonant frequency of the series resonant circuit by a simple circuit configuration. When the driving frequency after the start of lighting is continuously changed from the frequency before the start of lighting, the discharge lamp can be stably transferred to an arc discharge through the starting.

The control signal producing portion may control an operating frequency in the series resonant circuit so as to approach a resonant frequency by producing the frequency control signal. When the control signal producing portion is disposed, the power which is to be supplied to a lighting controlling circuit is brought close to the maximum value, whereby the lighting stability can be further enhanced.

According to exemplary embodiments of the present invention, in a lighting control of a discharge lamp, a lighting property can be sufficiently maintained correspondingly with environmental characteristics such as variations of the power source voltage and dispersions of the operating temperature, and characteristics of circuit components.

Other aspects of the present invention may also be apparent from the following detailed description, the accompanying drawings and the claims.

BRIEF DESCRIPTION OF THE DRAWINGS

FIGS. 3(*a*), 3(*b*), and 3(*c*) are views showing signal waveforms in a series resonant circuit in a case where a driving frequency is in an inductive region, and FIG. 3(*a*) shows a signal waveform of an input voltage, FIG. 3(*b*) shows a signal waveform of an input current, and FIG. 3(*c*) shows a signal waveform which is obtained by shaping an input current to a rectangular wave;

FIGS. 4(*a*), 4(*b*), and 4(*c*) are views showing signal waveforms in a series resonant circuit in a case where the driving frequency is in a capacitive region, and FIG. 4(*a*) shows a signal waveform of an input voltage, FIG. 4(*b*) shows a signal waveform of an input current, and FIG. 4(*c*) shows a signal waveform which is obtained by shaping an input current to a rectangular wave;

FIGS. 6(*a*), 6(*b*), 6(*c*), and 6(*d*) are views showing signal waveforms in a case where the series resonant circuit is in an inductive region, and FIG. 6(*a*) shows a waveform of an input voltage, FIG. 6(*b*) shows a signal waveform which is obtained by shaping an input current to a rectangular wave, FIG. 6(*c*) shows a waveform of an inductive detection signal, and FIG. 6(*d*) shows a waveform of a capacitive inductive detection signal;

FIGS. 7(*a*), 7(*b*), 7(*c*), and 7(*d*) are views showing signal waveforms in a case where a series resonant circuit is in a capacitive region, and FIG. 7(*a*) shows a waveform of an input voltage, FIG. 7(*b*) shows a signal waveform which is obtained by shaping an input current to a rectangular wave, FIG. 7(*c*) shows a waveform of an inductive detection signal, and FIG. 7(*d*) shows a waveform of a capacitive inductive detection signal;

DETAILED DESCRIPTION OF EXEMPLARY EMBODIMENTS OF THE PRESENT INVENTION

Figure 1:
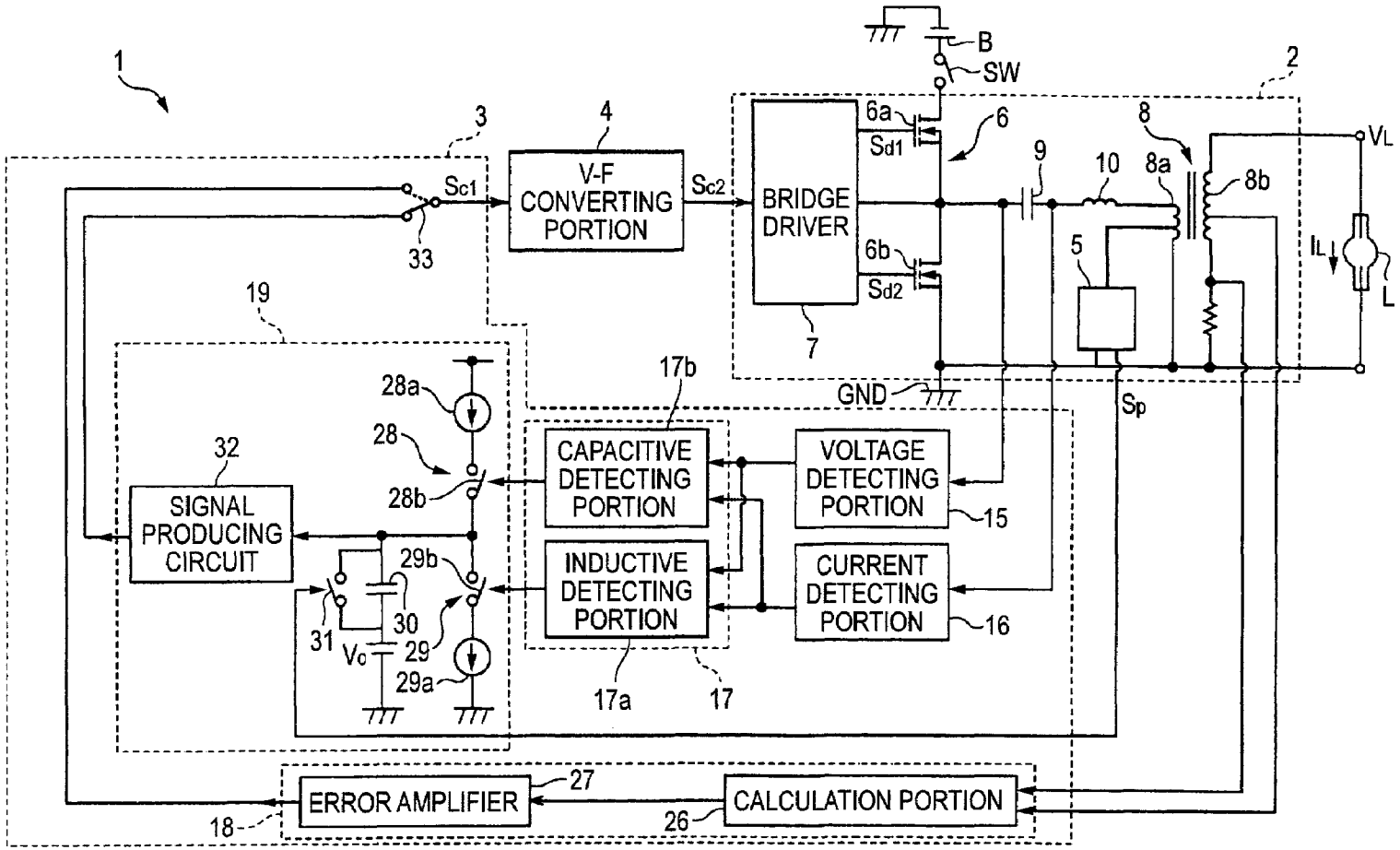
FIG. 1 is a block diagram showing a configuration of a discharge lamp lighting circuit according to an exemplary embodiment of the present invention.

Hereinafter, exemplary embodiments of the discharge lamp lighting circuit of the present invention will be described in detail with reference to the accompanying drawings. In the description of the drawings, identical or corresponding parts are denoted by the same reference numerals, and their duplicated description will be omitted.

FIG. 1 is a block diagram showing a configuration of a discharge lamp lighting circuit according to an exemplary embodiment of the present invention. The discharge lamp lighting circuit 1 shown in FIG. 1 supplies an AC power for lighting a discharge lamp L, to the discharge lamp L, or converts a DC voltage from a DC power source B to an AC voltage, and supplies the AC voltage to the discharge lamp L. The discharge lamp lighting circuit 1 may, for example, be used in a lighting device for a vehicle, such as a head lamp. Moreover, the discharge lamp lighting circuit 1 may be used in a broad range of applications, basically wherever a head lamp is used. As the discharge lamp L, for example, a mercury-free metal halide lamp may be used. However, a discharge lamp of another kind is also contemplated and may also be used with the discharge lamp lighting circuit according to an exemplary embodiment of the present invention.

Returning to FIG. 1, the discharge lamp lighting circuit 1 comprises: a power supplying portion 2 which receives a power supply from the DC power source B, and which supplies AC power to the discharge lamp L; a controlling portion 3 which controls a level of the power to be supplied to the discharge lamp L; and a voltage-frequency (V-F) converting portion 4 which performs voltage-frequency conversion (V-F conversion) on a frequency control signal $S_{C1}$ which is an analog signal supplied from the controlling portion 3, to produce a control signal $S_{C2}$.

The power supplying portion 2 supplies a power, the level of which is based on the control signal $S_{C2}$ supplied from the V-F converting portion 4, to the discharge lamp L. The power supplying portion 2 is coupled to the DC power source B, such as a DC battery, to receive the DC voltage from the DC power source B, and performs AC converting and voltage boosting operations. In an exemplary embodiment of the present invention, the power supplying portion 2 comprises: a starting portion 5 which, at the start of lighting, applies a high-voltage pulse to the discharge lamp L to promote lighting; a half-bridge inverter (i.e., an inverter circuit) 6 in which two transistors 6*a*, 6*b* that are switching elements are connected in series; and a bridge driver (i.e., a driving circuit) 7 which drives the transistors 6*a*, 6*b* so as to be alternatingly switched. As shown in FIG. 1, for example, N-channel metal oxide semiconductor field effect transistors (MOSFETs) may be used as the transistors 6*a*, 6*b*. Alternatively, other FETs or bipolar transistors may be used. In this exemplary embodiment, the drain terminal of the transistor 6*a* is coupled to a positive terminal of the DC power source B via a switch SW which is used for starting the lighting operation, the source terminal of the transistor 6*a* is coupled to the drain terminal of the transistor 6*b*, and the gate terminal of the transistor 6*a* is coupled to the bridge driver 7. The source terminal of the transistor 6*b* is coupled to a ground potential line GND (i.e., a minus terminal of the DC power source B), and the gate terminal of the transistor 6*b* is coupled to the bridge driver 7. The bridge driver 7 supplies drive signals $S_{d1}$, $S_{d2}$, which are opposite in phase to each other on the basis of the control signal $S_{C2}$ that is a pulse signal, to the gate terminals of the transistors 6*a*, 6*b*, thereby causing the transistors 6*a*, 6*b* to be alternatingly conductive.

The power supplying portion 2 further comprises a transformer 8, a capacitor 9, and an inductor 10. The transformer 8 is disposed so as to apply a high-voltage pulse to the discharge lamp L, transmit the power, and boost the power. The transformer 8, the capacitor 9, and the inductor 10 comprise a series resonant circuit. Namely, the primary winding 8*a* of the transformer 8, the inductor 10, and the capacitor 9 are coupled in series. One end of the series circuit is coupled to the source terminal of the transistor 6*a* and the drain terminal of the transistor 6*b*, and the other end is coupled to the ground potential line GND. According to this configuration, the resonant frequency is determined by a combined reactance configured by the leakage inductance of the primary winding 8*a* of the transformer 8, and the inductance of the inductor 10, and the capacitance of the capacitor 9. Alternatively, the series resonant circuit may be configured by only the primary winding 8*a* and the capacitor 9, and the inductor 10 may be omitted. Alternatively, the inductance of the primary winding 8*a* may be set to be much smaller than that of the inductor 10, and the resonant frequency may be determined substantially by the inductor 10 and the capacitance of the capacitor 9.

In the power supplying portion 2, the transistors 6*a*, 6*b* are alternatingly turned on and off, thereby causing an AC power to be produced in the primary winding 8*a* of the transformer 8. The AC power is transmitted to the secondary winding 8*b* of the transformer 8 while being boosted, and then supplied to the discharge lamp L coupled to the secondary winding 8*b*. The bridge driver 7 which drives the transistors 6*a*, 6*b* complementarily drives the transistors 6*a*, 6*b* so that both the transistors 6*a*, 6*b* are not simultaneously in the conductive state.

Figure 2:
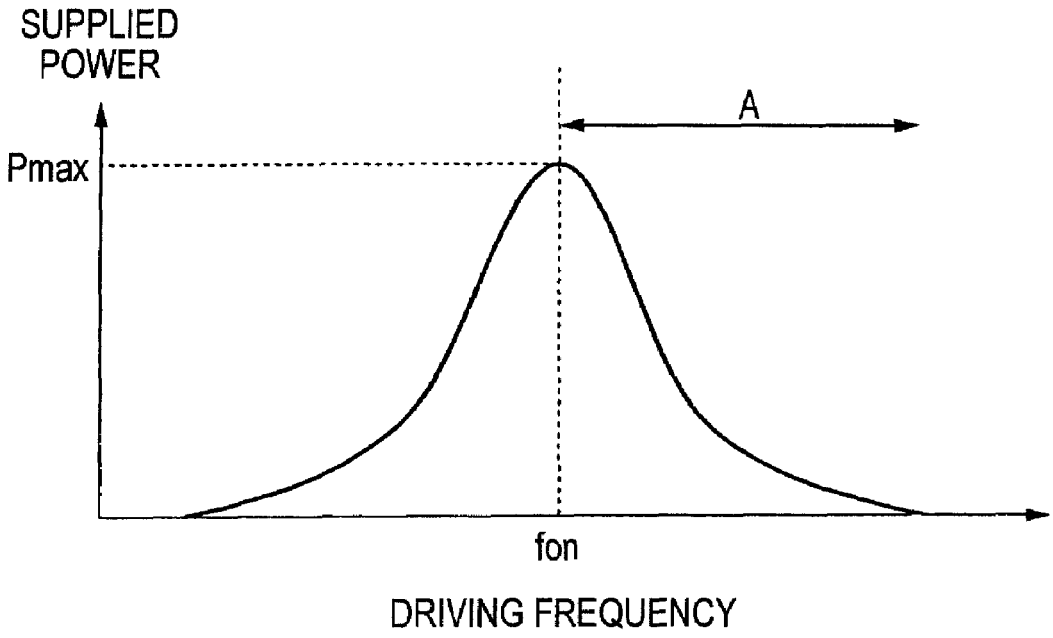
FIG. 2 is a graph conceptually showing relationships between a driving frequency and a supplied power.

Hereinafter, relationships between the driving frequency of the series resonant circuit of the power supplying portion 2, and the power supplied to the discharge lamp L will be described with reference to FIG. 2. FIG. 2 is a graph conceptually showing the relationships between the driving frequency of the transistors 6*a*, 6*b* and the supplied power. As shown in the figure, the level of the power supplied to the discharge lamp L has a maximum value Pmax when the driving frequency is equal to the resonant frequency fon of the series resonant circuit, and decreases as the driving frequency is increased (or decreased) from the resonant frequency fon of the series resonant circuit. This decrease in level as the driving frequency moves away from the resonant frequency fon of the series resonant circuit occurs because an impedance of the series resonant circuit is changed by the frequency of driving of the transistors 6*a*, 6*b* by the bridge driver 7. Therefore, the level of the AC power to be supplied to the discharge lamp L can be controlled by changing the driving frequency. When the driving frequency is lower than the resonant frequency fon, however, a switching loss increases and power efficiency is consequently reduced. Therefore, it is advantageous to control the magnitude of the driving frequency of the bridge driver 7 so as to be within a region A in FIG. 2, a region where the driving frequency is higher than the resonant frequency fon. The region where the frequency is lower than the resonant frequency fon is referred to as a capacitive region, and the region where the frequency is higher than the resonant frequency fon is referred to as an inductive region.

FIGS. 3(*a*), 3(*b*), and 3(*c*), and FIGS. 4(*a*), 4(*b*), and 4(*c*) show relationships between the voltage and current which are supplied from the half-bridge inverter 6 to the series resonant circuit in a case where the driving frequency is in the inductive region or the capacitive region, respectively. FIGS. 3(*a*), 3(*b*), and 3(*c*) are views showing signal waveforms in a case where the driving frequency is in the inductive region, and 3(*a*) shows the signal waveform of an input voltage $V_1$, FIG. 3(*b*) shows the signal waveform of an input current $I_1$, and FIG. 3(*c*) shows a signal waveform $I_2$ which is obtained by shaping the input current to a rectangular wave. FIGS. 4(*a*), 4(*b*), and 4(*c*) are views showing signal waveforms in a case where the driving frequency is in the capacitive region, and FIG. 4(*a*) shows the signal waveform of an input voltage $V_1$, FIG. 4(*b*) shows the signal waveform $I_2$ of an input current $I_1$, and FIG. 4(*c*) shows a signal waveform which is obtained by shaping the input current $I_1$ to a rectangular wave. As seen from these figures, in the case where the driving frequency is in the inductive region, the input voltage $V_1$ leads in phase the input current $I_1$, and, in the case where the driving frequency is in the capacitive region, the input voltage $V_1$ lags in phase the input current $I_1$.

Returning to FIG. 1, the starting portion 5 of the discharge lamp lighting circuit 1 is a circuit for applying a high-voltage pulse for starting to the discharge lamp L. A trigger voltage and current (i.e., a high-voltage pulse) are applied to the primary winding 8*a* of the transformer 8, whereby the high-voltage pulse is superimposed on the AC voltage produced in the secondary winding 8*b* of the transformer 8. Specifically, the starting portion 5 comprises: a starting capacitor which stores power for producing the high-voltage pulse; a self-breakdown switching element (not shown) such as a spark gap or a gas arrester; and the like. In the starting portion 5, when the voltage across the starting capacitor is caused to reach the discharge starting voltage by charging the starting capacitor during the lighting starting operation, the self-breakdown switching element is momentarily set to the conductive state, thereby outputting the trigger voltage and current. At the moment the trigger voltage and current are generated, the starting portion 5 produces a pulse detection signal $S_p$, and transmits the pulse detection signal $S_p$ to the controlling portion 3 which will be described below.

The controlling portion 3 of the discharge lamp lighting circuit 1 is a circuit for controlling a frequency of the drive signals $S_{d1}$, $S_{d2}$ supplied from the bridge driver 7, to adjust the driving frequency of the series resonant circuit, and has a voltage detecting portion 15, a current detecting portion 16, a phase difference detecting portion 17, a first control signal producing portion 18, and a second control signal producing portion 19.

The voltage detecting portion 15 detects the input voltage $V_1$ which is supplied from the half-bridge inverter 6 to the series resonant circuit, and supplies a detection signal of the input voltage $V_1$ shaped to a rectangular wave, to the phase difference detecting portion 17. Similarly, the current detecting portion 16 detects the input current $I_1$ which is supplied from the half-bridge inverter 6 to the series resonant circuit, and supplies a detection signal $I_2$ of the input current $I_1$ shaped to a rectangular wave, to the phase difference detecting portion 17. As a method by which the current detecting portion 16 detects the input current $I_1$, various methods may be employed. Because the capacitance of the capacitor 9 is known, for example, the waveform of the input current $I_1$ can be obtained by detecting the voltages at the both ends of the capacitor 9.

The phase difference detecting portion 17 is a circuit which detects the phase difference between the input voltage $V_1$ and the input current $I_1$ to obtain information relating to an inductive depth or a capacitive depth at the driving frequency of the series resonant circuit, and is configured by an inductive detecting circuit (i.e, a first phase difference detecting circuit) 17*a* and a capacitive detecting circuit (i.e., a second phase difference detecting circuit) 17*b*.

Figure 5:
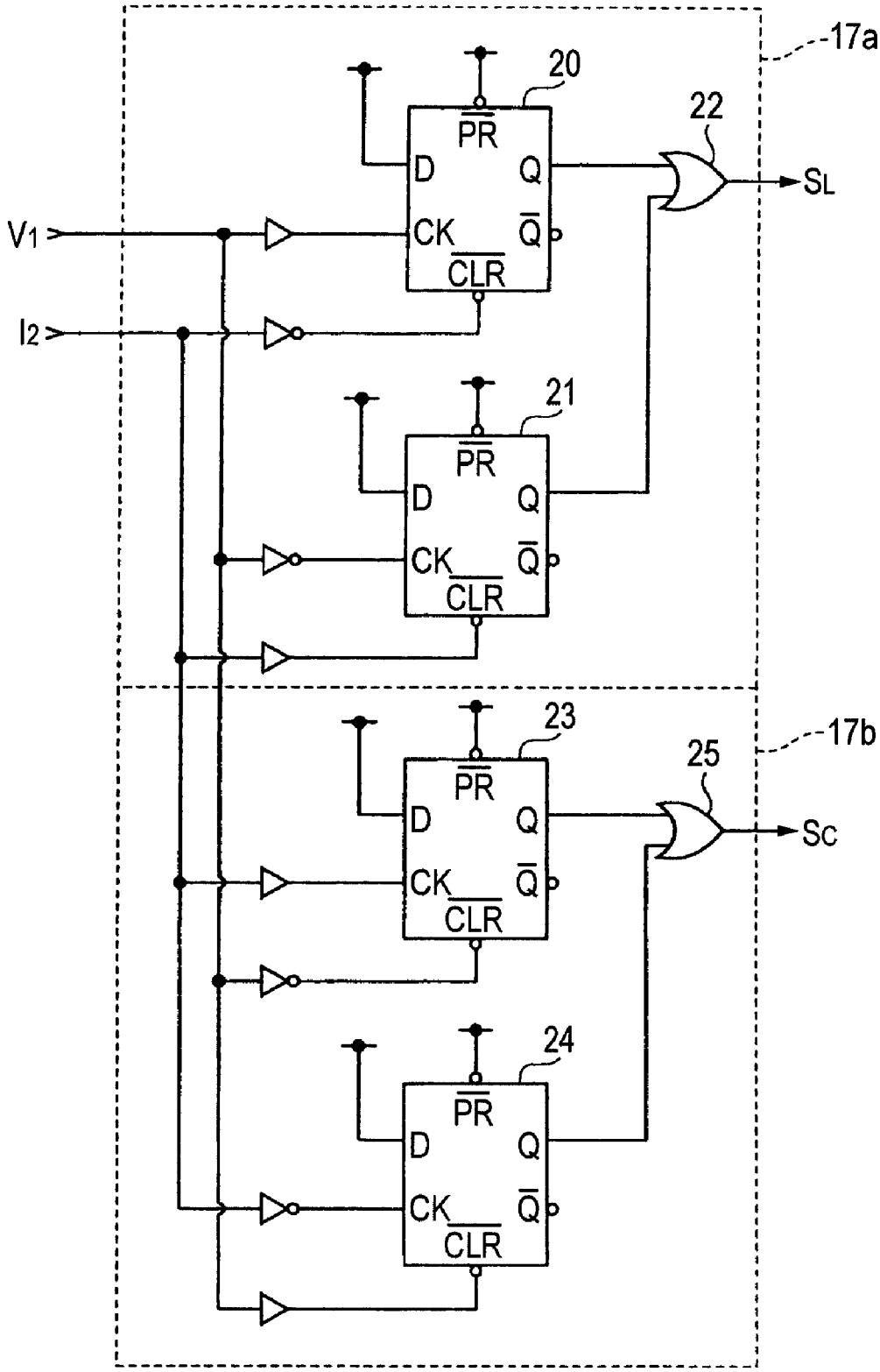
FIG. 5 is a circuit diagram showing a configuration of a phase difference detecting portion.

FIG. 5 shows the circuit configuration of the phase difference detecting portion 17 in more detail. As shown in the figure, the inductive detecting circuit 17*a* comprises two D flip-flops 20, 21 and an OR circuit 22, and the capacitive detecting circuit 17*b* comprises two D flip-flops 23, 24 and an OR circuit 25. The data (D) terminals of the D flip-flops 20, 21, 23, 24 are biased to a positive voltage and are fixed to a high level. The detection signal of the input voltage $V_1$ is supplied to the clock (CK) terminal of the D flip-flop 20, a voltage which is an inversion of the detection signal of the input voltage $V_1$ is supplied to the CK terminal of the D flip-flop 21, the signal waveform $I_2$ which is obtained by shaping the input current $I_1$ to a rectangular wave is supplied to the clock (CK) terminal of the D flip-flop 23, and a voltage which is an inversion of the signal waveform $I_2$ is supplied to the CK terminal of the D flip-flop 24. The Q outputs of the flip-flops 20, 21 are supplied to the OR circuit 22, and the output of the OR circuit 22 is set as an inductive detection signal $S_L$ of the inductive detecting circuit 17*a*. The Q outputs of the flip-flops 23, 24 are supplied to the OR circuit 25, and the output of the OR circuit 25 is set as a capacitive inductive detection signal $S_C$ of the capacitive detecting circuit 17*b*.

FIGS. 6(*a*), 6(*b*), 6(*c*), and 6(*d*) are views showing signal waveforms in a case where the series resonant circuit of the power supplying portion 2 is in the inductive region, and FIG. 6(*a*) shows a waveform of the input voltage $V_1$, FIG. 6(*b*) shows a waveform of the signal $I_2$ which is obtained by shaping the input current $I_1$ to a rectangular wave, FIG. 6(*c*) shows a waveform of the inductive detection signal $S_L$, and FIG. 6(*d*) shows a waveform of the capacitive inductive detection signal $S_C$. In this way, the inductive detection signal $S_L$ produced by the inductive detecting circuit 17*a* is at a high level during a time period from a rise of $V_1$ when $I_2$ is at a low level, to a rise of $I_2$, and that from a fall of $V_1$ when $I_2$ is at a high level, to a fall of $I_2$. When the input voltage $V_1$ leads in phase the input current $I_1$, therefore, the inductive detecting circuit 17*a* produces an inductive detection signal $S_L$ having a pulse width that is proportional to the phase difference. Namely, the pulse width of the inductive detection signal $S_L$ indicates the inductive depth of the series resonant circuit in the driven state.

By contrast, FIGS. 7(*a*), 7(*b*), 7(*c*), and 7(*d*) are views showing signal waveforms in a case where the series resonant circuit of the power supplying portion 2 is in the capacitive region, and FIG. 7(*a*) shows a waveform of the input voltage $V_1$, FIG. 7(*b*) shows a waveform of the signal $I_2$, FIG. 7(*c*) shows a waveform of the inductive detection signal $S_L$, and FIG. 7(*d*) shows a waveform of the capacitive inductive detection signal $S_C$. In this way, the capacitive detection signal $S_C$ produced by the inductive detecting circuit 17*b* is at a high level during a time period from a rise of $I_2$ when $V_1$ is at a low level, to a rise of $V_1$, and that from a fall of $I_2$ when $V_1$ is at a high level, to a fall of $V_1$. When the input voltage $V_1$ lags in phase the input current $I_1$, therefore, the capacitive detecting circuit 17*b* produces a capacitive detection signal $S_C$ having a pulse width that is proportional to the phase difference. Namely, the pulse width of the capacitive detection signal $S_C$ indicates the capacitive depth of the series resonant circuit in the driven state.

Returning again to FIG. 1, on the basis of the lamp voltage $V_L$ and lamp current $I_L$ of the discharge lamp L, the first control signal producing portion 18 controls the driving frequency of the bridge driver 7 (i.e., the level of the power supplied to the discharge lamp L). The first control signal producing portion 18 is a circuit which produces a frequency control signal $S_{C1}$ so that a level of the open circuit voltage (OCV) or power to be supplied to the discharge lamp L becomes close to a threshold value (which may be predetermined), and is configured by a calculation portion 26 and an error amplifier 27. The calculation portion 26 calculates the voltage applied to the discharge lamp L or the supplied power on the basis of the values of the lamp voltage $V_L$ and lamp current $I_L$ which are detected on the side of the secondary winding 8*b* of the transformer 8, and produces a voltage signal so that the calculated voltage or supplied power become close to a threshold value or time function. The error amplifier 27 inverts and amplifies the voltage signal supplied from the calculation portion 26, and outputs the resulting signal as the frequency control signal $S_{C1}$. In accordance with the voltage level of the frequency control signal $S_{C1}$, the driving frequency of the bridge driver 7 is controlled.

The second control signal producing portion 19 controls the driving frequency of the bridge driver 7 on the basis of the inductive detection signal $S_L$ and capacitive inductive detection signal $S_C$ which are produced by the phase difference detecting portion 17. The second control signal producing portion 19 comprises a charging circuit 28, a discharging circuit 29, a detection capacitor 30, a switch element 31, and a signal producing circuit 32.

The charging circuit 28 is configured by coupling a current source 28*a* and a switch element 28*b* in series. One end of the current source 28*a* is coupled to a power source to be set to a positive voltage $V_{CC}$, and the other end is coupled to the switch element 28*b*. By contrast, the discharging circuit 29 is configured by coupling a current source 29*a* and a switch element 29*b* in series. One end of the current source 29*a* is grounded, and the other end is coupled to the switch element 29*b*. The switch elements 28*b*, 29*b* are coupled to each other, so that the charging circuit 28 and the discharging circuit 29 comprise a series circuit. The current source 28*a* supplies a current to the discharging circuit 29 via the switch element 28*b*, and the current source 29*a* sinks a current from the discharging circuit 29 via the switch element 29*b*. The switch element 29*b* is turned on and off in accordance with the inductive detection signal $S_L$ from the inductive detecting circuit 17*a*, and the switch element 28*b* is turned on and off in accordance with the capacitive inductive detection signal $S_C$ from the capacitive detecting circuit 17*b*. The combinations of the current source 28*a* and the switch element 28*b*, and the current source 29*a* and the switch element 29*b* may be replaced with circuits which operate so as to perform switching between the operation of the corresponding current source and a high impedance in accordance with the inductive detection signal $S_L$ or the capacitive inductive detection signal $S_C$.

One end of the detection capacitor 30 is set to an intermediate voltage $V_o$ between the positive voltage $V_{CC}$ supplied to the charging circuit 28, and the ground voltage supplied to the discharging circuit 29, and the other end is coupled to the charging circuit 28 and the discharging circuit 29. The intermediate voltage $V_o$ may be set to any value between the positive voltage $V_{CC}$ and the ground voltage.

According to this configuration, a current is supplied from the charging circuit 28 to the other end of the detection capacitor 30 in accordance with the capacitive inductive detection signal $S_C$, and the discharging circuit 29 sinks a current from the other end of the detection capacitor 30 in accordance with the inductive detection signal $S_L$. By the charging and discharging circuits including the current sources, namely, the time change of the voltage across the detection capacitor 30 is made constant irrespective of the capacitor voltage. Therefore, the voltage across the detection capacitor 30 is increased or decreased in accordance with the phase difference between the input voltage $V_1$ and the input current $I_1$, i.e., the inductive and capacitive depths of the series resonant circuit.

The switch element 31 is coupled across the detection capacitor 30, and used for resetting the driven state detected by the detection capacitor 30. The switch element 31 receives the pulse detection signal $S_p$ from the starting portion 5, and is turned on in synchronization with the timing of producing the pulse detection signal $S_p$, whereby the charges stored in the detection capacitor 30 are discharged.

Figure 8:
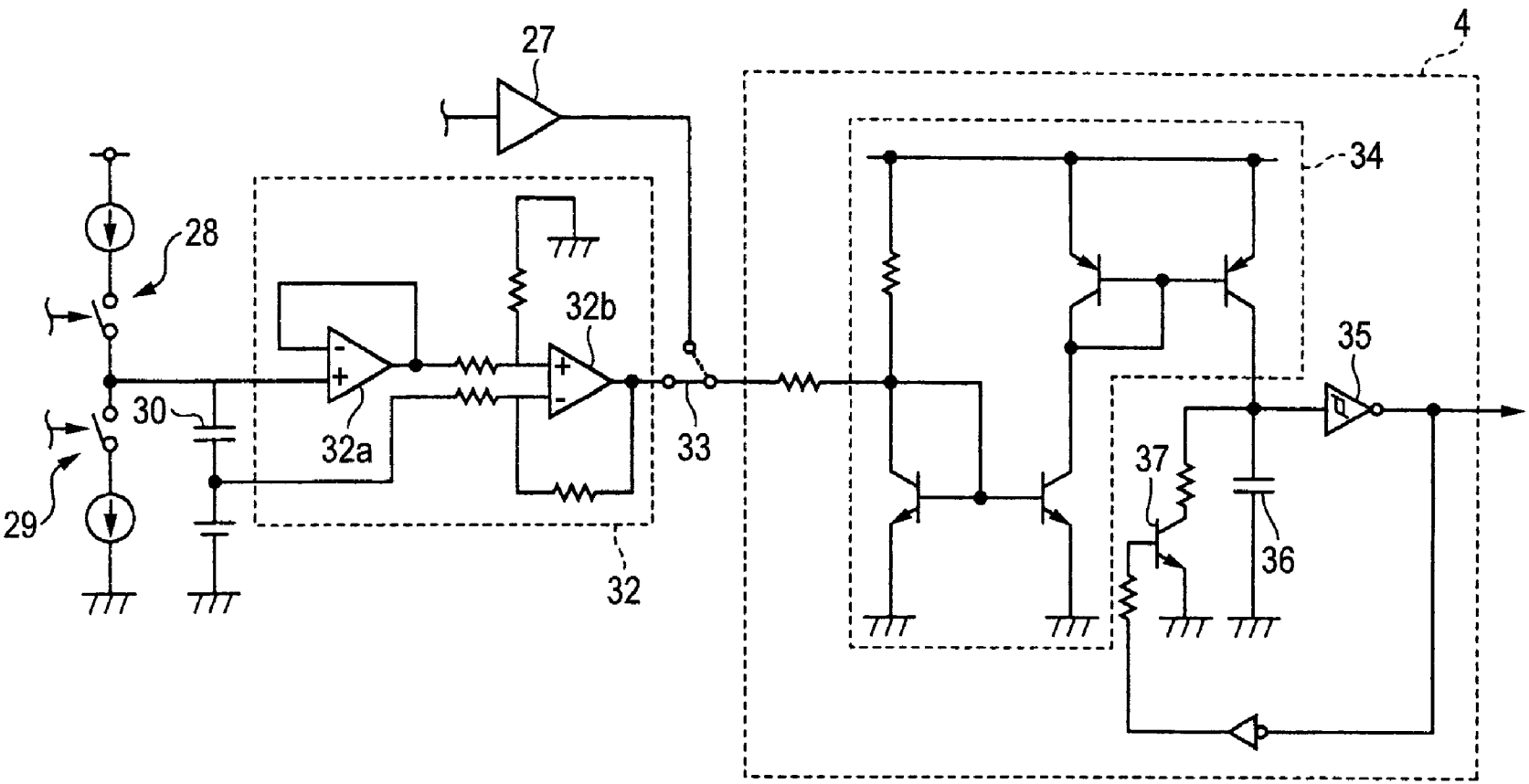
FIG. 8 is a circuit diagram showing in detail a configuration of a signal producing circuit and a voltage-frequency (V-F) converting portion shown in FIG. 1.

In accordance with the voltage across the detection capacitor 30, the signal producing circuit 32 produces the frequency control signal $S_{C1}$ which corresponds to the voltage, and outputs the signal to the V-F converting portion 4 via a switch 33. FIG. 8 is a circuit diagram showing in detail the configuration of the signal producing circuit 32 and the V-F converting portion 4. As shown in the figure, the signal producing circuit 32 comprises two differential amplifiers 32*a*, 32*b* for setting a high input impedance, detects the voltage across the detection capacitor 30, and supplies the voltage as the frequency control signal $S_{C1}$ to the switch 33. The switch 33 is a switch element for switching between the error amplifier 27 of the first control signal producing portion 18 and the signal producing circuit 32, and the V-F converting portion 4, and is controlled so that, before the start of the discharge lamp L, the error amplifier 27 and the V-F converting portion 4 are coupled to each other, and, immediately after the start of lighting the discharge lamp L, the signal producing circuit 32 and the V-F converting portion 4 are coupled to each other. Before the start of the discharge lamp L, therefore, the driving frequency is controlled by the lamp voltage $V_L$ and the lamp current $I_L$, and, immediately after the start of lighting the discharge lamp L, the driving frequency is controlled by the input voltage $V_1$ and input current $I_1$ of the series resonant circuit.

The V-F converting portion 4 comprises a current mirror circuit portion 34, a hysteresis comparator 35, a capacitor 36, and a transistor 37. The current mirror circuit portion 34 produces and outputs a current corresponding to the frequency control signal $S_{C1}$ supplied from the signal producing circuit. One end of the capacitor 36 is coupled to the output of the current mirror circuit portion 34, and the other end is grounded. The collector terminal of the transistor 37 is coupled to the one end of the capacitor 36, and the emitter terminal is grounded. The input of the hysteresis comparator 35 is coupled to the one end of the capacitor 36, and the output is coupled to the base terminal of the transistor 37. According to the configuration, the control signal $S_{C2}$ having a pulse wave of a frequency corresponding to the level of the frequency control signal $S_{C1}$ is produced from the output of the V-F converting portion 4.

According to the discharge lamp lighting circuit 1 according to an exemplary embodiment of the present invention, the phase difference between the input voltage $V_1$ and input current $I_1$ which are supplied from the half-bridge inverter 6 to the series resonant circuit is detected, whereby the inductive and capacitive depths of the series resonant circuit as viewed from the half-bridge inverter 6 are determined, and the driving frequency of the half-bridge inverter 6 is increased or decreased on the basis of the phase difference. According to this exemplary configuration, the driving frequency of the half-bridge inverter 6 can be adjusted following the resonant frequency of the series resonant circuit so as to become close to the resonant frequency. Even when circuit or environmental characteristics such as variations of the power source voltage and dispersions of the operating temperature are varied, therefore, a sufficient power can be supplied to the discharge lamp, and the lighting stability of the discharge lamp can be improved.

Furthermore, the phase difference detecting portion 17 according to an exemplary embodiment of the present invention produces the inductive detection signal $S_L$ having a pulse width corresponding to the inductive depth, and also the capacitive inductive detection signal $S_C$ having a pulse width corresponding to the capacitive depth. In the second control signal producing portion 19, the detection capacitor 30 is charged or discharged in accordance with the pulses of the two signals, and the driving frequency of the control signal $S_{C2}$ of the half-bridge inverter 6 is adjusted in accordance with the across voltage of the detection capacitor 30. Therefore, the driving frequency of the half-bridge inverter can be caused to follow the resonant frequency of the series resonant circuit by a simple circuit configuration.

Furthermore, in an exemplary embodiment of the present invention, the one end of the detection capacitor 30 is set to an intermediate voltage between the power source voltage of the charging circuit 28 and that of the discharging circuit 29. When even a small degree of deviation from the resonant frequency occurs, therefore, the voltage across the detection capacitor 30 is saturated to an upper or lower limit value after elapse of a certain time period. When the following speeds of the circuits are not considered, namely, the speed of following the resonant frequency is uniquely determined by the current values of the current sources 28*a*, 29*a* and the gain of the V-F converting portion 4 in the subsequent stage. Therefore, a high-speed resonance following control can be realized at a reduced number of circuit parameters. Consequently, the frequency can surely follow in accordance with both the inductive and capacitive states of the series resonant circuit.

The second control signal producing portion 19 discharges the detection capacitor 30 in accordance with the detection of a high-voltage pulse in the starting portion 5, and resets the state of the series resonant circuit which was detected in the past, at the start of lighting. In the case where the circuit is set so that the driving frequency is rapidly changed after the application of the high-voltage pulse, therefore, the frequency can be caused to follow immediately and stably the resonant frequency of the series resonant circuit in accordance with a state at the start of lighting.

The present invention is not restricted to the above-described exemplary embodiments however. For example, the controlling portion 3 operates so as to, when the capacitive is detected, charge the detection capacitor 30, and, when the inductive is detected, discharge the detection capacitor 30. Alternatively, according to another exemplary embodiment of the present invention, the controlling portion 3 may operate in a reverse manner. In the alternative, the driving frequency may be controlled so as to become lower as the voltage across the detection capacitor 30 becomes higher.

Figure 9:
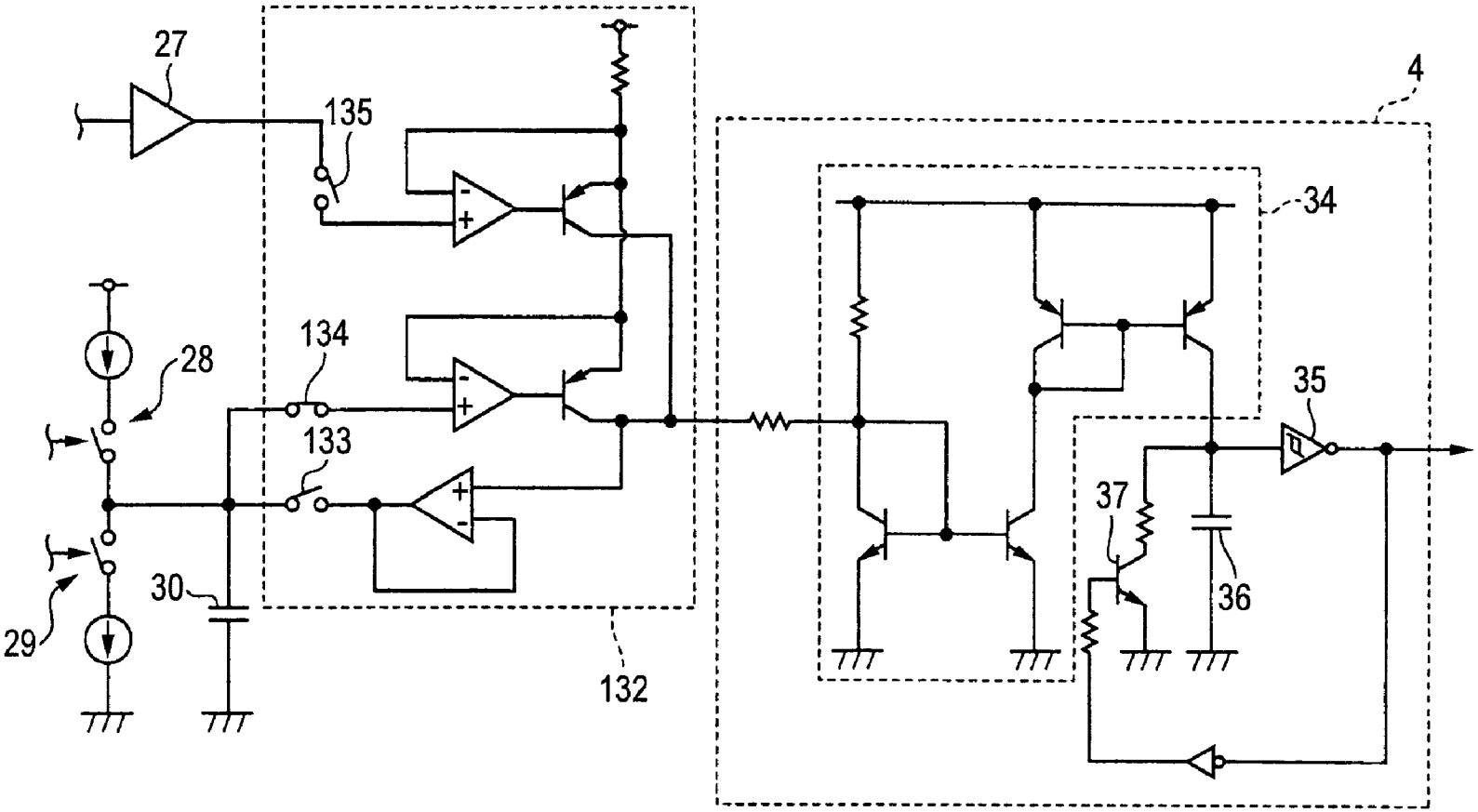
FIG. 9 is a circuit diagram showing in detail a configuration of a signal producing circuit and a V-F converting portion of a discharge lamp lighting circuit according to another exemplary embodiment of the present invention.

Alternatively, according to another exemplary embodiment of the present invention, the discharge lamp lighting circuit may be configured so that the voltage across the detection capacitor 30 causes the frequency control signal $S_{C1}$ supplied to the V-F converting portion 4 to be continuously changed through the starting of the discharge lamp L. FIG. 9 is a circuit diagram of a signal producing circuit 132 which is a modification of the invention configured described above. The signal producing circuit 132 comprises three switch elements (i.e., switch portions) 133, 134, 135 that are coupled together in parallel to one end of the detection capacitor 30 and the other end of the detection capacitor 30 is grounded. The switch elements 134, 135 are coupled to an input of the V-F converting portion 4 via buffers dedicated to sweeping, and the switch element 133 is coupled to the input of the V-F converting portion 4 via a buffer. The switch elements 133, 134, 135 are turned on and off in accordance with the pulse detection signal $S_p$ from the starting portion 5. Specifically, before the start of the discharge lamp L, the switch elements 133, 135 are turned on, and the switch element 134 is turned off. By contrast, immediately after the start of lighting the discharge lamp L, the switch elements 133, 135 are turned off, and the switch element 134 is turned on. According to this exemplary configuration, before the application the high-voltage pulse to the discharge lamp L, the first control signal producing portion 18 supplies the frequency control signal $S_{C1}$ to the V-F converting portion 4, and the voltage which is generated by the frequency control signal $S_{C1}$ is applied to the detection capacitor 30 through the switch element 133. Therefore, a voltage corresponding to the present driving frequency of the half-bridge inverter 6 is applied to the detection capacitor 30 to charge the capacitor. By contrast, immediately after the application the high-voltage pulse to the discharge lamp L, the frequency control signal $S_{C1}$ corresponding to the across voltage of the detection capacitor 30 of the second control signal producing portion 19 is supplied to the V-F converting portion 4. According to the signal producing circuit 132 according to this exemplary embodiment of the present invention, the frequency in the series resonant circuit before the start of lighting is continuously changed to the driving frequency after the start of lighting, whereby the discharge lamp can be stably transferred to an arc discharge through the starting.

Figure 10:
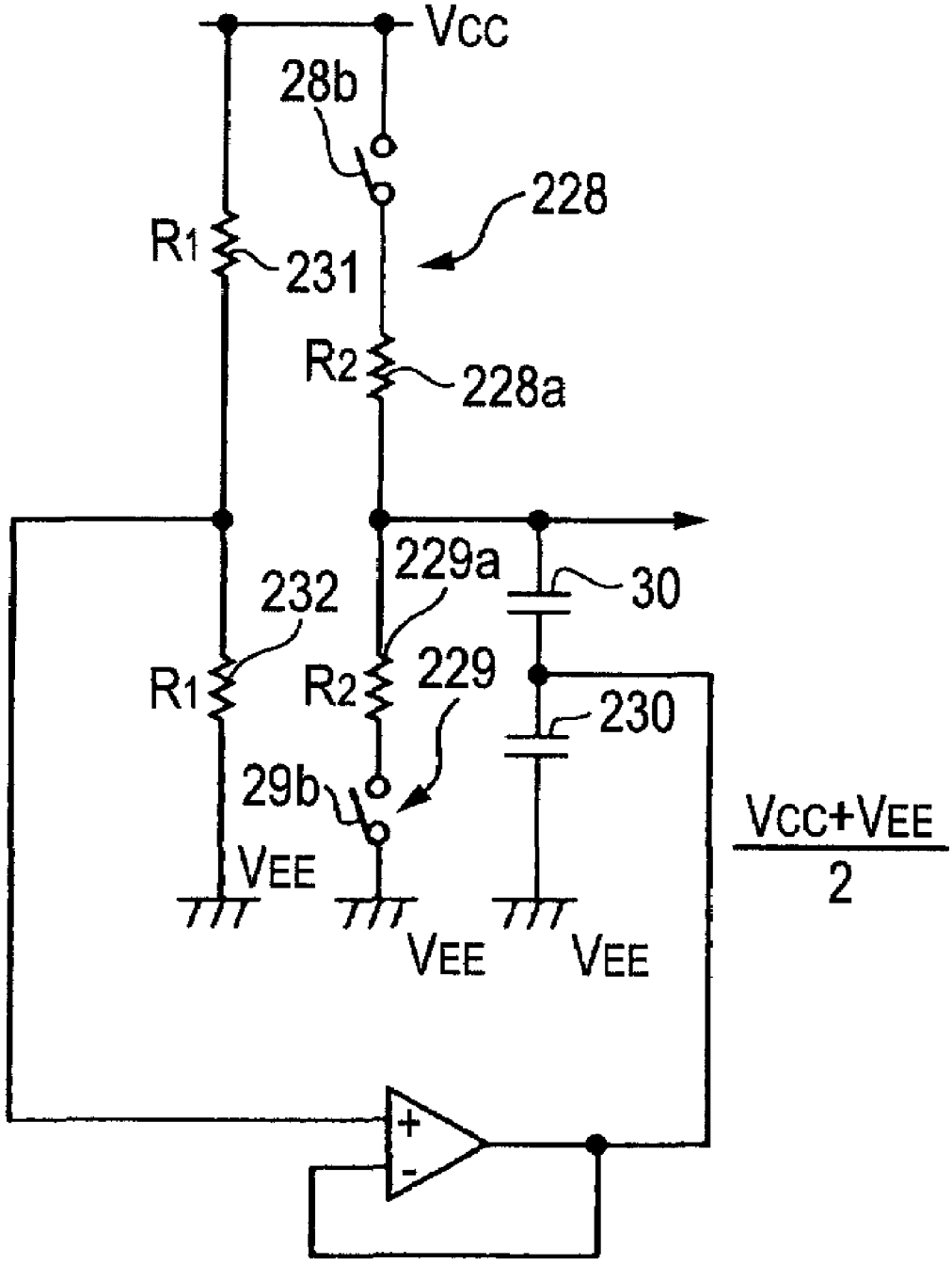
FIG. 10 is a circuit diagram showing in detail a configuration of charging and discharging circuits of a discharge lamp lighting circuit according to an exemplary embodiment of the present invention.
Figure 11:
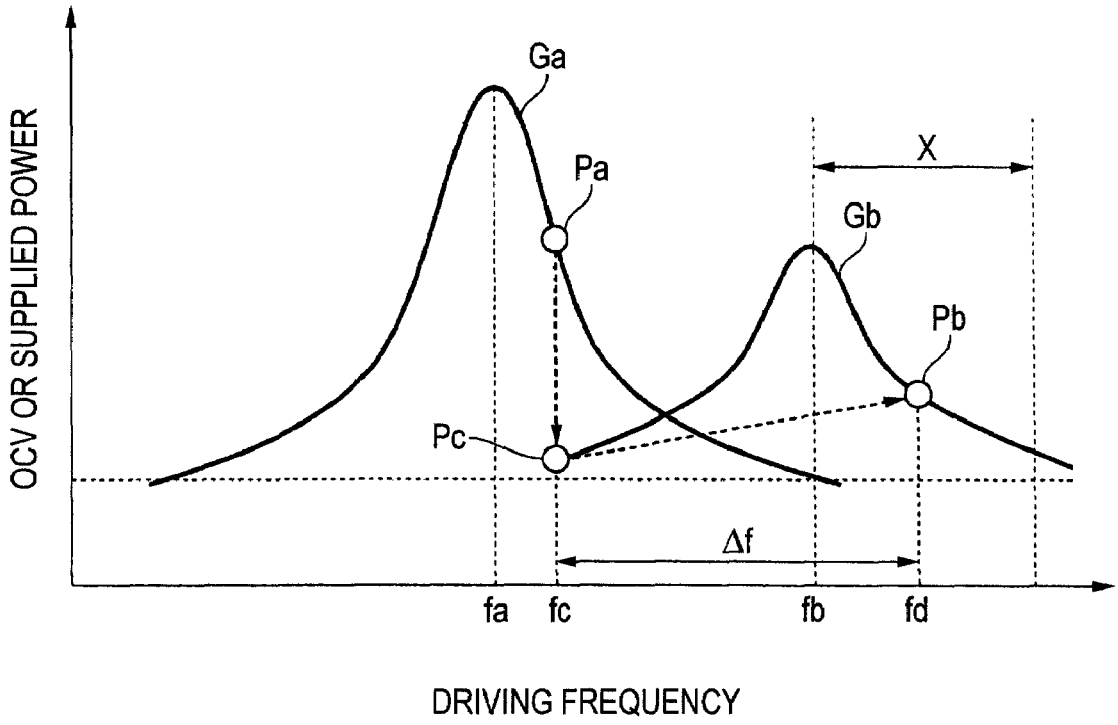
FIG. 11 RELATED ART
FIG. 11 is a graph conceptually showing relationships between a driving frequency of the series resonant circuit and a level of the supplied power according to the related art.

The charging and discharging circuits are not restricted to have a configuration including a current source. In the case where a current source cannot be used for any reason such as the cost or the performance of a current source, an exemplary configuration such as shown in FIG. 10 may be used. FIG. 10 is a circuit diagram of a configuration including charging and discharging circuits 228, 229 which comprise another exemplary embodiment of the present invention. As shown in the figure, the charging circuit 228 is a series circuit configured by a resistor 228*a* and the switch element 28*b*, and the discharging circuit 229 is a series circuit configured by a resistor 229*a* and the switch element 29*b*. The positive voltage $V_{CC}$ is applied to one end of the charging circuit 228, a ground voltage $V_{EE}$ is applied to one end of the discharging circuit 229, and the charging circuit 228 and the discharging circuit 229 are coupled in series in the respective other end sides. One end of the detection capacitor 30 is coupled to the connection between the two circuits, and the other end of the detection capacitor 30 is grounded via a capacitor 230. A voltage of $(V_{CC}+V_{EE})/2$ which is obtained by dividing the voltages by resistors 231, 232 is applied to the other end of the detection capacitor 30. The capacitor 230 is disposed in order to smooth the voltage (current) applied to the detection capacitor 30.

According also to the exemplary circuit configuration including the thus configured charging and discharging circuits 228, 229, the detection capacitor 30 can be charged or discharged in accordance with the inductive and capacitive depths. In a charging or discharging circuit configured by a capacitor and a resistor, however, the time change of the capacitor voltage at a certain timing is determined depending on the capacitor voltage at the timing (because the capacitor voltage is exponentially changed). When the relationship between the degree of deviation of the frequency directed to inductivity and a voltage change of the capacitor is different from that between the degree of deviation of the frequency directed to conductivity and the voltage change of the capacitor, the convergence of the resonant frequency is affected. Therefore, the reference voltage of the detection capacitor 30 is set to $(V_{CC}+V_{EE})/2$ or an intermediate voltage, and hence the changes of the capacitor voltage with respect to the degree of deviation from the resonant frequency in both inductivity and conductivity can be made equal to each other. As a result, the stability of the following of the resonant frequency can be enhanced.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A discharge lamp lighting circuit comprising:

a power supplying portion which comprises an inverter circuit comprising a switching element;

a series resonant circuit comprising a capacitor, and at least one of an inductor and a transformer; and a driving circuit which drives said switching element, said power supplying portion converting DC power to AC power and supplying the AC power to a discharge lamp; and a controlling portion which produces a frequency control signal for controlling a frequency of a drive signal output from said driving circuit, the controlling portion comprising:

a phase difference detecting portion which detects a phase difference between an input voltage and an input current that are supplied from said inverter circuit to said series resonant circuit; and a control signal producing portion which produces the frequency control signal in accordance with the phase differences, wherein said phase difference detecting portion comprises:

a first phase difference detecting circuit which, when a phase of the input voltage leads a phase of the input current, produces an inductive detection signal having a pulse width that is proportional to the phase difference; and a second phase difference detecting circuit which, when the phase of the input voltage lags the phase of the input current, produces a capacitive detection signal having a pulse width that is proportional to the phase difference, wherein said control signal producing portion comprises:

a detection capacitor, one end of which is set to a first voltage;

a charging circuit which is coupled to another end of said detection capacitor, said charging circuit supplying a current to said another end of said detection capacitor in accordance with one of the inductive detection signal and the capacitive detection signal;

a discharging circuit which is coupled to said another end of said detection capacitor, and which sinks a current from said another end of said detection capacitor in accordance with the other one of the inductive detection signal and the capacitive detection signal; and a signal producing circuit which detects a voltage across said detection capacitor, and which produces the frequency control signal so as to control the frequency of the drive signal in accordance with a voltage across said detection capacitor, wherein the first voltage is set to a value less than a power source voltage supplied to said charging circuit, and greater than a power source voltage supplied to said discharging circuit.

2. A discharge lamp lighting circuit according to claim 1, further comprising a starting portion which applies a high-voltage pulse to said discharge lamp to promote lighting, and wherein said control signal producing portion discharges said detection capacitor in accordance with a detection of the high-voltage pulse in said starting portion.

3. A discharge lamp lighting circuit according to claim 1, wherein said control signal producing portion controls an operating frequency of said series resonant circuit so as to approach a resonant frequency using the frequency control signal.

4. A discharge lamp lighting circuit comprising:

a power supplying portion which comprises an inverter circuit comprising a switching element;

a series resonant circuit comprising a capacitor, and at least one of an inductor and a transformer; and a driving circuit which drives said switching element, said power supplying portion converting DC power to AC power and supplying the AC power to a discharge lamp; and a controlling portion which produces a frequency control signal for controlling a frequency of a drive signal output from said driving circuit, the controlling portion comprising:

a phase difference detecting portion which detects a phase difference between an input voltage and an input current that are supplied from said inverter circuit to said series resonant circuit;

a control signal producing portion which produces the frequency control signal in accordance with the phase difference; and a starting portion which applies a high-voltage pulse to said discharge lamp to promote lighting, and wherein said phase difference detecting portion comprises:

a first phase difference detecting circuit which, when a phase of the input voltage leads a phase of the input current, produces an inductive detection signal having a pulse width that is proportional to the phase difference; and a second phase difference detecting circuit which, when a phase of the input voltage lags a phase of the input current, produces a capacitive detection signal having a pulse width that is proportional to the phase difference, and wherein said control signal producing portion comprises:

a detection capacitor;

a charging circuit which is coupled to said detection capacitor, and which supplies a current to said detection capacitor in accordance with one of the inductive detection signal and the capacitive detection signal;

a discharging circuit which is coupled to said detection capacitor, and which sinks a current from said detection capacitor in accordance with the other one of the inductive detection signal and the capacitive detection signal;

a signal producing circuit which receives a voltage across said detection capacitor, and which produces the frequency control signal so as to control the frequency of the drive signal in accordance with a voltage across said detection capacitor; and a switch portion which supplies the voltage across said detection capacitor to said signal producing circuit in accordance with a detection of the high-voltage pulse in said starting portion, and which, before detection of the high-voltage pulse, applies a voltage corresponding to a present frequency of the drive signal, to said detection capacitor.

5. A discharge lamp lighting circuit according to claim 4, wherein said control signal producing portion controls an operating frequency of said series resonant circuit so as to approach a resonant frequency using the frequency control signal.

* * * * *